US010258206B2

(12) United States Patent
Nelson et al.

(10) Patent No.: US 10,258,206 B2
(45) Date of Patent: Apr. 16, 2019

(54) CONTAINER

(71) Applicant: VERNACARE LIMITED, Bolton (GB)

(72) Inventors: Wayne Nelson, Radcliffe (GB); Joseph Langley, Sheffield (GB); Peter Graham Richard MacQueen, Sheffield (GB); Mark Phillips, Sheffield (GB); Matt Willox, Sheffield (GB)

(73) Assignee: VERNACARE LIMITED, Bolton Lancashire (GB)

( * ) Notice: Subject to any disclaimer, the term of this patent is extended or adjusted under 35 U.S.C. 154(b) by 23 days.

(21) Appl. No.: 15/034,155

(22) PCT Filed: Nov. 4, 2014

(86) PCT No.: PCT/GB2014/053278

§ 371 (c)(1),
(2) Date: May 3, 2016

(87) PCT Pub. No.: WO2015/063521

PCT Pub. Date: May 7, 2015

(65) Prior Publication Data

US 2016/0262583 A1 Sep. 15, 2016

(30) Foreign Application Priority Data

Nov. 4, 2013 (GB) ..... 1319433.7

(51) Int. Cl.
*A47K 11/12* (2006.01)
*A61G 9/00* (2006.01)
(Continued)

(52) U.S. Cl.
CPC ..... *A47K 11/12* (2013.01); *A61G 9/006* (2013.01); *B65D 5/3607* (2013.01); *B65D 5/4266* (2013.01)

(58) Field of Classification Search
CPC .... A61G 9/006; B65D 5/3628; B65D 5/3621; B65D 5/4266; B65D 5/0209; A61F 5/4556
(Continued)

(56) References Cited

U.S. PATENT DOCUMENTS 1,025,606 A 5/1912 Bayless et al.
2,574,246 A * 11/1951 Crosby ..... A61G 9/006 229/110
(Continued)

FOREIGN PATENT DOCUMENTS

AU 3489371 A 5/1973
DE 7506481 U 7/1975
(Continued)

OTHER PUBLICATIONS

United Kingdom Search Report dated Apr. 7, 2014 for Application No. GB 1319433.7 from United Kingdom Intellectual Property Office, pp. 1-5, South Wales, United Kingdom.
(Continued)

*Primary Examiner* — David P Angwin
*Assistant Examiner* — Nicholas A Ros
(74) *Attorney, Agent, or Firm* — Sherman IP LLP; Kenneth L. Sherman; Steven Laut

(57) ABSTRACT

A container, in particular a urine bottle formed from maceratable sheet material comprises an enclosing wall and an aperture. The container is expandable from a first, collapsed configuration into a second, expanded configuration. The sheet material has a plurality of fold lines which define one or more recesses in the enclosing wall of the container in the expanded configuration. In the collapsed condition, the container comprises a lower sheet and an upper sheet lying below a sheet, the upper and lower sheets being sealed together along their lateral edges and along a first, end edge
(Continued)

between a first, lower end of the lateral edges. The lateral edges taper towards each other and the aperture extends between the second, opposite ends of the lateral edges.

18 Claims, 17 Drawing Sheets

(51) Int. Cl.
*B65D 5/36* (2006.01)
*B65D 5/42* (2006.01)

(58) Field of Classification Search
USPC ..... 229/106, 107, 111, 4.5; 4/114.1, 144.2, 4/451; 604/329
See application file for complete search history.

(56) References Cited

U.S. PATENT DOCUMENTS 3,005,992 A * 10/1961 Sullivan ..... A61B 10/007 229/117.01
3,099,017 A * 7/1963 Sullivan ..... A61B 10/007 4/144.2
3,535,714 A * 10/1970 Bjork ..... A61G 9/006 229/115
3,579,653 A * 5/1971 Kuhn ..... A61G 9/006 4/144.2
3,731,869 A * 5/1973 Griffin ..... A61G 9/006 229/111
4,751,751 A * 6/1988 Reno ..... A61F 5/4556 141/337
4,974,966 A 12/1990 Fabbi
5,437,406 A 8/1995 Gordon et al.
5,725,147 A 3/1998 Ljungstorm
6,351,858 B1 * 3/2002 Toia ..... A61G 9/00 220/4.01
2010/0038361 A1 * 2/2010 Hwang ..... B65D 85/816 220/23.83

FOREIGN PATENT DOCUMENTS

GB 898903 A 6/1962
GB 1030542 A 5/1966
GB 1170543 A 11/1969
GB 2439947 A 1/2008
JP 2002-102111 A 4/2002
JP 2007159797 A 6/2007
WO 2004014265 A1 2/2004

OTHER PUBLICATIONS

International Search Report and Written Opinion dated Jan. 29, 2015 for International Application No. PCT/GB2014/053278 from European Patent Office, pp. 1-9, Risjswijk, Netherlands.

* cited by examiner

CONTAINER

The present invention relates generally to collapsible containers and in particular, but not exclusively, to collapsible male urine bottles.

Urine bottles are frequently used in, for example, hospitals and nursing homes for patients who are either confined to bed or who are otherwise unable to use a toilet. Disposable urine bottles are known, which can be discarded after use, thus eliminating the requirement to empty, clean and sterilise a traditional, non-disposable urine bottle.

However, in spite of these advantages, a disposable urine bottle typically takes up the same amount of storage space as a non-disposable urine bottle. It will be appreciated that a greater number of disposable urine bottles will need to be stored, since they are single-use only. This greater number vastly increases storage space required, which can be problematic in hospitals and similar environments, in which storage space is limited.

In view of this, collapsible urine bottles have been developed, such as that disclosed in U.S. Pat. No. 3,099,017. The urine bottle comprises scorings which allow it to be folded up to its erected or collapsed configurations. The urine bottle also comprises a handle which acts to hold the urine bottle in its erected configuration. However, there are several problems associated with this device. Namely, the nature of the scoring is particularly complicated which is likely to increase manufacturing costs, but perhaps more significantly, results in a multi-stage assembly process, in order to erect the bottle. It will be appreciated that this laborious set up process is impractical in a busy medical environment.

A further known arrangement is disclosed in U.S. Pat. No. 3,579,653. However, aside from also being quite a complicated arrangement of score lines, the nature of the folding mechanism, for example the inward and upward folding of the bottom wall along a median fold line, is unlikely to give a user confidence that the bottle will resist folding during use.

The present invention has been designed with the foregoing in mind.

In accordance with the present invention, there is provided a container formed from sheet material, the container comprising an enclosing wall and an aperture and being expandable from a first, collapsed configuration into a second, expanded configuration, the sheet material having a plurality of fold lines which define one or more recesses in the enclosing wall of the container in the expanded configuration, wherein in the collapsed condition the container comprises a lower sheet and an upper sheet overlying the lower sheet, the upper and lower sheets being sealed together along their lateral edges and along a first, end edge extending between a first end of each of the lateral edges, the lateral edges tapering towards each other and the aperture extending between the second, opposite ends of the lateral edges.

The container in accordance with the present invention can be stood in a substantially flat configuration, which greatly reduces the volume required for storage. When required for use, a collapsed container can be transformed into an expanded urinal. The or each recess in the enclosing wall of the container facilitates manipulation, lifting and carrying of the container and also helps to retain the container in its expanded configuration.

Preferably, the upper sheet and lower sheet are of substantially the same shape and dimensions.

In one embodiment, when the container is in the first, collapsed condition, each of the upper and lower sheets is substantially planar and comprises a front edge, two side edges and a rear edge, the front edge joining one end of each of the side edges and the rear edge joining the other end of the side edges.

Preferably, the side edges and rear edges of the upper and lower sheets are joined to each other. Preferably, the front edges of the upper and lower sheets are not joined to each other.

The rear edge may be arcuate, for example part-circular.

Preferably, the side edges of the planar sheets extend along the recesses.

Preferably, the lower sheet comprises a plurality of fold lines which form a base wall when the container is in the second, expanded configuration.

Preferably, the container comprises one or more arcuate fold lines which define a recess in the enclosing wall of the container in the expanded configuration.

The plurality of fold lines in the sheet material may define one or more elongate recesses in the enclosing wall of the container in the expanded configuration.

Preferably, the container is formed from a foldable sheet, for example foldable paper pulp card, including paperboard, paper or the like. Preferably the sheet is liquid resistant. For example, the pulp from which the sheet is made may comprise a water-resistant composition, such as the fluorocarbon compound disclosed in GB2439947. Alternatively, or in addition, the sheet may be provided with one or more liquid-resistant layers or coatings, for example of the fluorocarbon compound disclosed in GB2439947, or some other liquid-resistant layer or coating.

The container may be formed from a single, foldable blank.

Preferably, the material from which the container is made is maceratable.

In a preferred embodiment, the container comprises a urinal.

The present invention also provides a container formed from sheet material, the container comprising an enclosing wall and an aperture and being expandable from a first, collapsed configuration into a second, expanded configuration, the sheet material having a plurality of fold lines which define one or more recesses in the enclosing wall of the container in the expanded configuration.

In one embodiment, in the first, collapsed configuration the container comprises an upper sheet and a lower sheet overlying one another and joined to one another along a plurality of edges.

Preferably, the upper sheet and lower sheet are joined to one another continuously around their periphery except for a portion of the periphery which is configured to form the aperture of the container in its expanded configuration.

In one embodiment, the side walls of the upper and lower sheets converge towards the front edge.

By way of example only, specific embodiments of the present invention will now be described with reference to the accompanying drawings, in which.

A first embodiment of male urinal is shown in FIGS. 1 to 7. The urinal 10 is formed from a sheet of card formed from paper pulp, out of which is stamped the blank 12 shown in FIG. 7. The blank 12 is folded and glued to form into the collapsed urinal shown in FIGS. 5 and 6, which may be expanded when required to form the expanded urinal 10 shown in FIGS. 1 to 4, in which condition it is ready to use. The materials from which the urinal is constructed are such that the bottle is maceratable, i.e. it may be disposed of in a conventional macerator in which one or more impellers reduce the urinal to particles which are sufficiently small that they can be disposed of in conventional drains and sewers without significantly increasing the likelihood of blockages. The card from which the urinal 10 is constructed is also treated to make it impervious to urine for a predetermined period, typically a few hours, as for prior art urinals. For example, the pulp from which the card is made may comprise the fluorocarbon compound disclosed in GB2439947, or some other liquid-resistant additive. Alternatively, or in addition, the card may be provided with one or more liquid-resistant layers or coatings, for example of the fluorocarbon compound disclosed in GB2439947, or some other liquid-resistant layer or coating.

Figure 7:
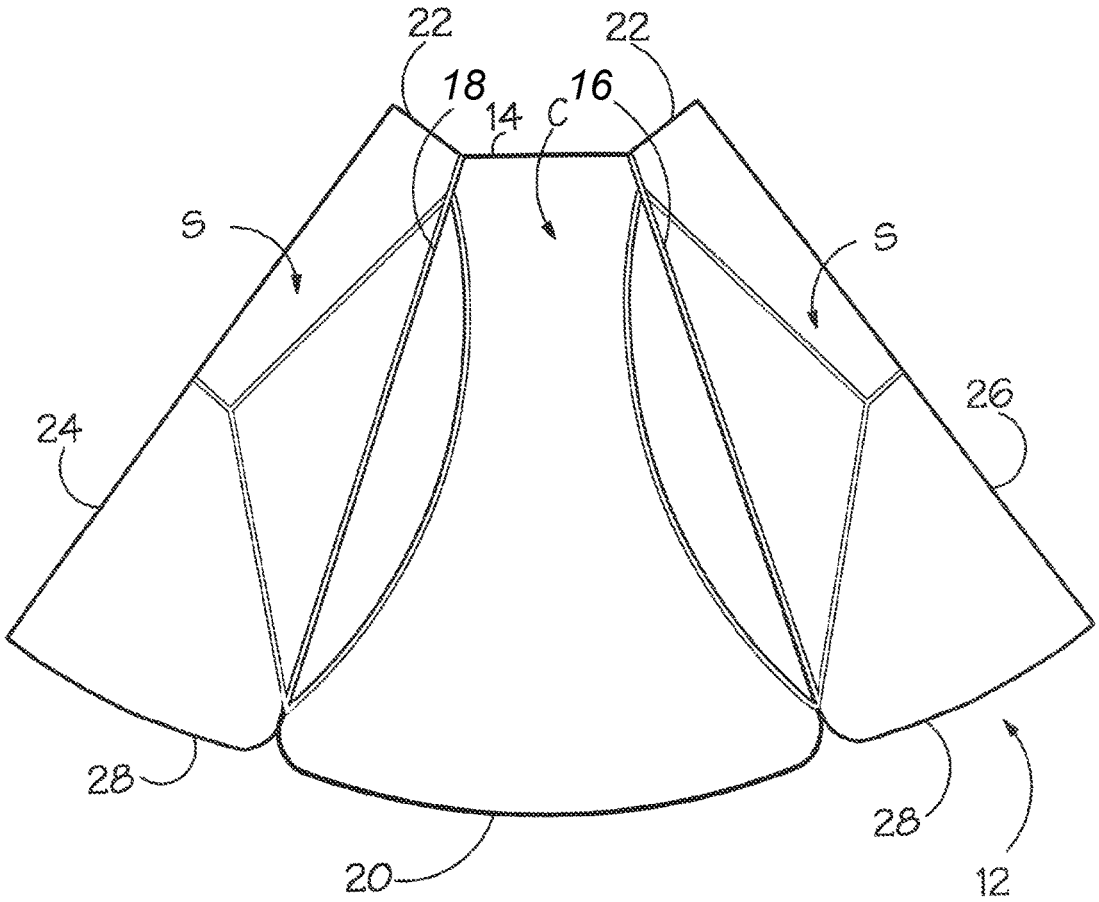
FIG. 7 is a view from above of the cardboard blank from which the male urinal of FIG. 1 is made.
Figure 8:
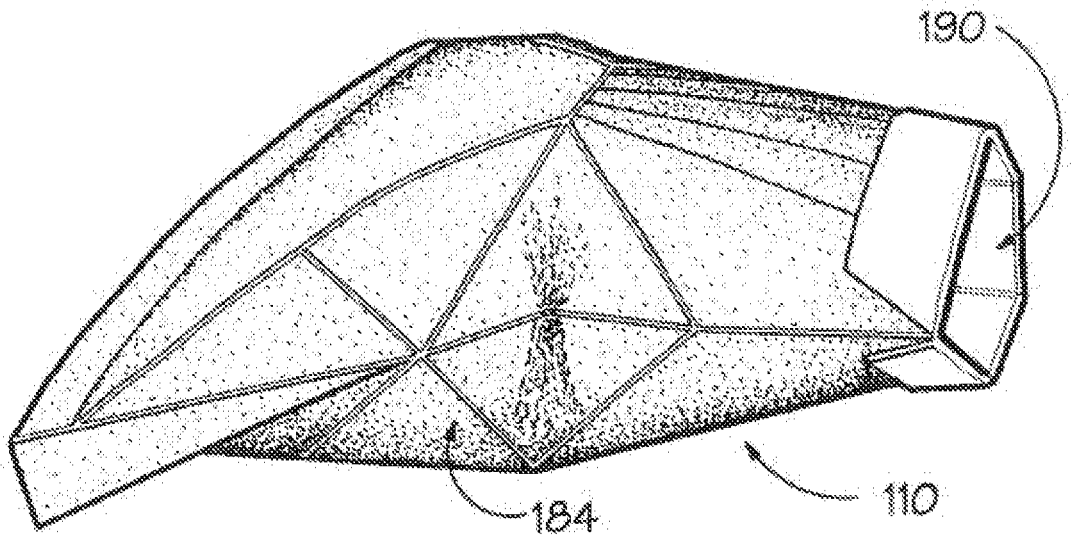
FIG. 8 is a perspective view of a second embodiment of collapsible male urinal in accordance with the present invention, shown in its expanded condition.
Figure 9:
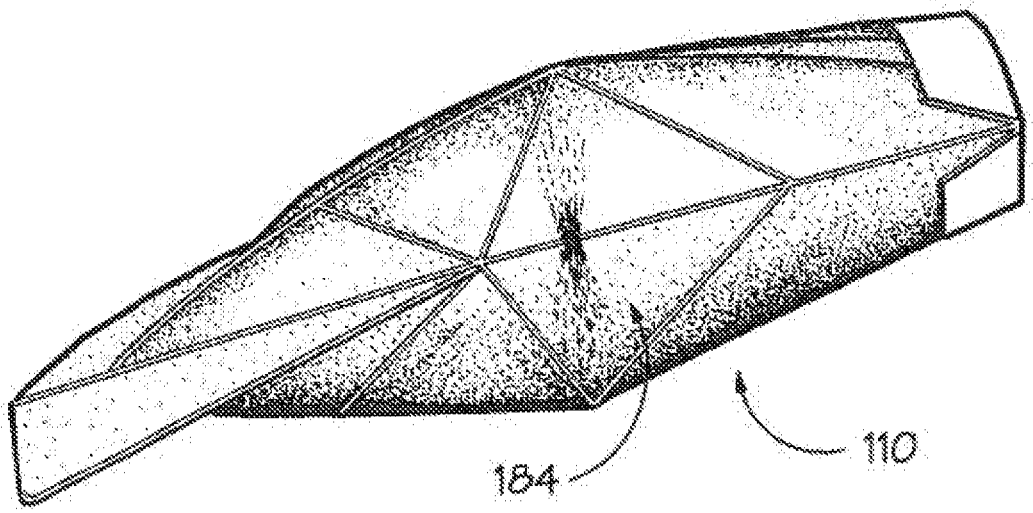
FIG. 9 is a side view of the male urinal of FIG. 8.
Figure 10:
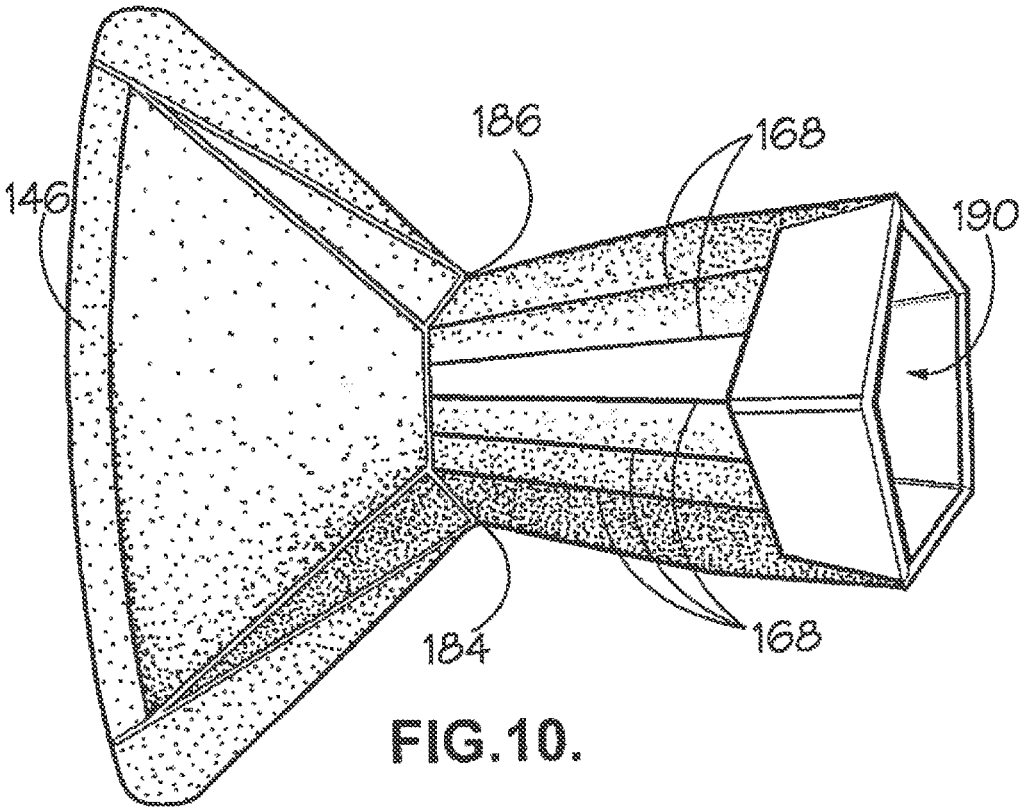
FIG. 10 is a view from above of the male urinal of FIG. 8
Figure 11:
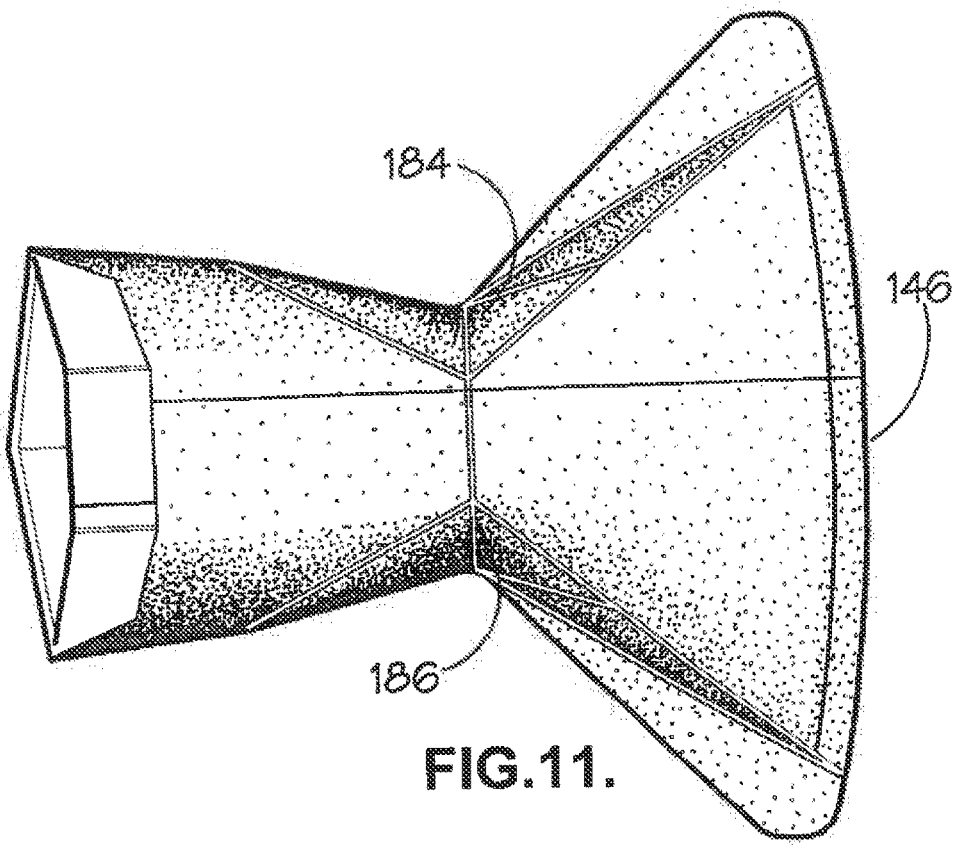
FIG. 11 is a view from below of the male urinal of FIG. 8.

As best seen in FIG. 7, the blank 12 comprises a central panel C having a short straight front edge 14, two straight side edges 16, 18 in the form of fold lines, which converge towards, and join, a respective end of the front edge 14, and a part-circular rear edge 20 which connects the other ends of the side edges 16, 18. Two side panels 5, mirror images of each other, extend from a respective one of the two side sides 16, 18 of the central panel C. Each side panel S comprises a straight front edge 22, a straight outer edge 24, 26 and a rounded, part-circular rear edge 28. The part-circular rear edge 28 is of the same radius as the part-circular rear edge 20 of the central panel C and the side panels S are slightly wider than the width of the central panel C. Consequently, when the side panels S are folded in towards each other along the respective edges 16, 18 of the central panel C, they lie flat on the surface of the central panel and the edges of the side panels S overlap each other, as do the peripheries of the part-circular rear edges 20 of the central panel C and of the side panels S.

Figure 5:
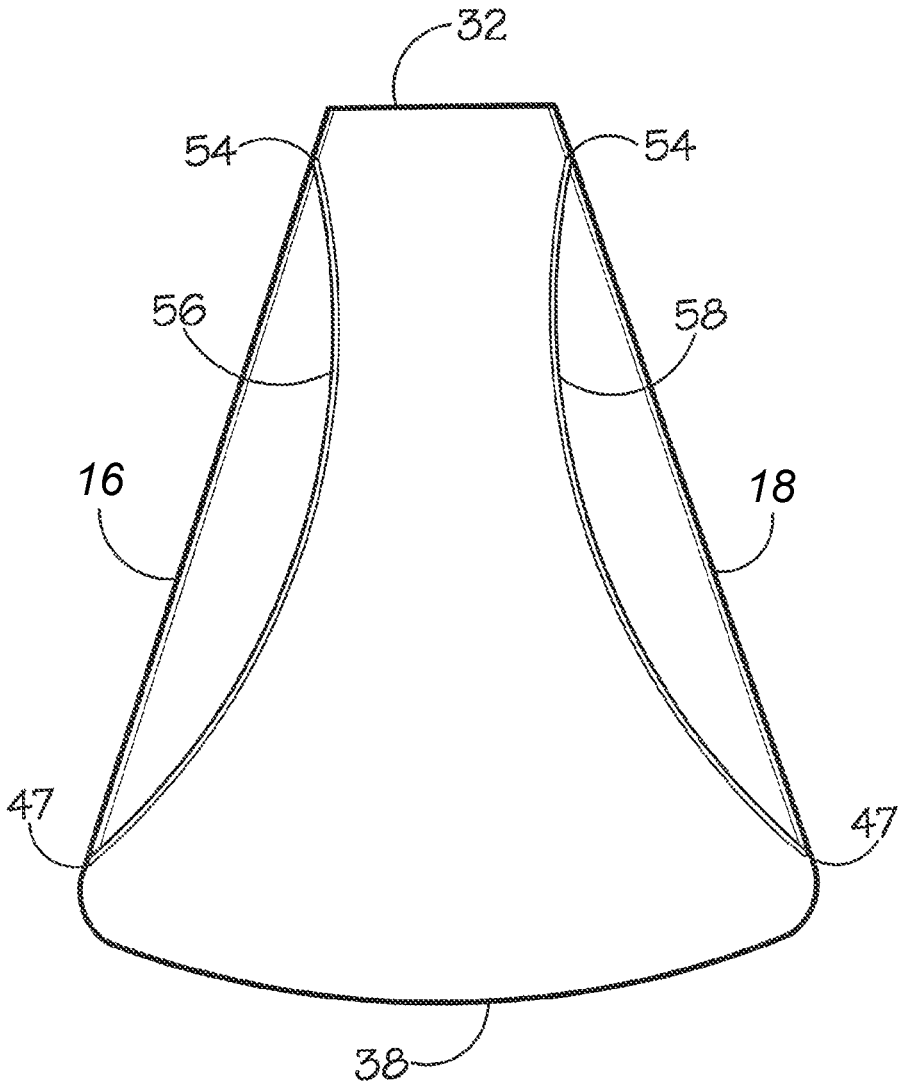
FIG. 5 is a view from above of the male urinal of FIG. 1, shown in a collapsed condition.
Figure 6:
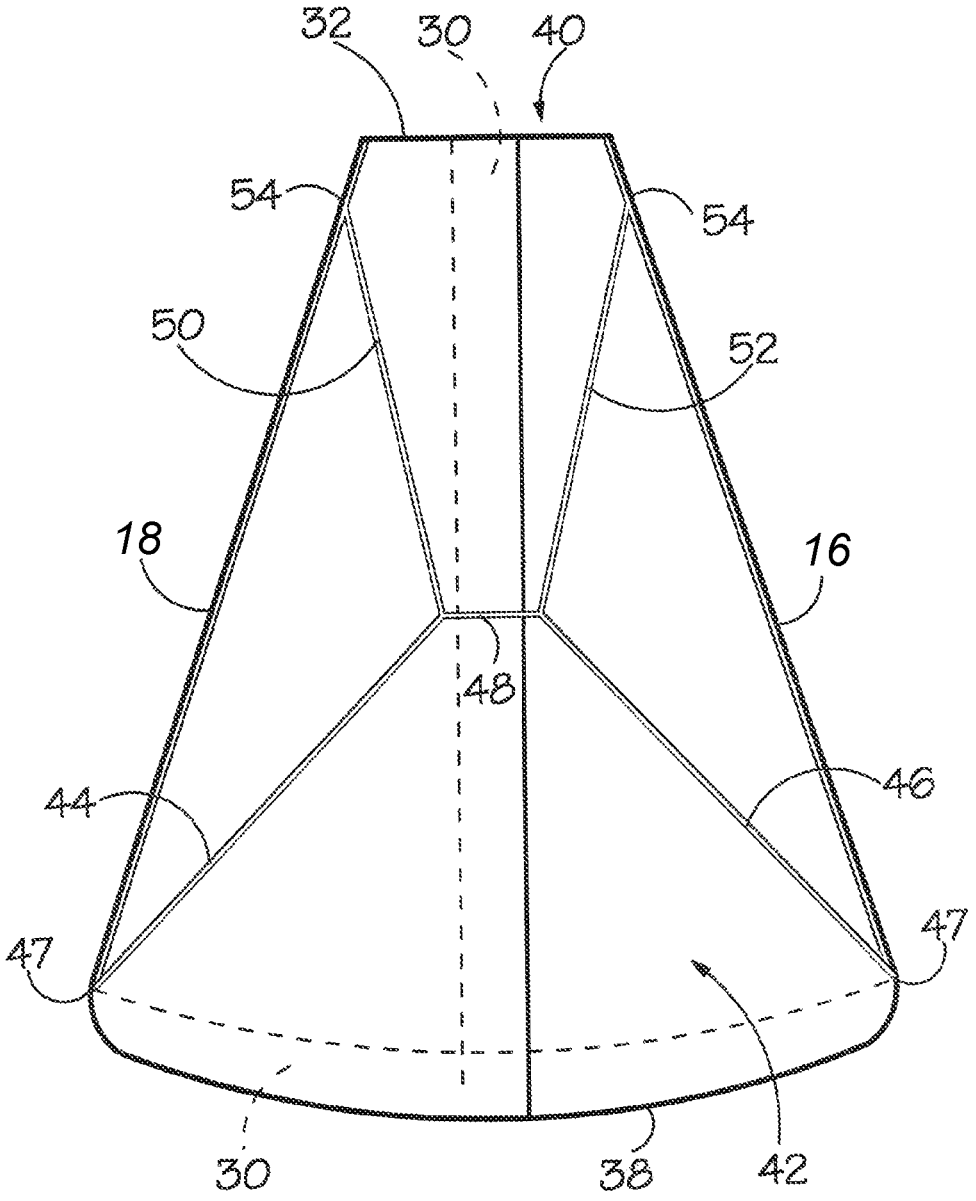
FIG. 6 is a view from below of the male urinal of FIG. 1, shown in a collapsed condition.

The overlapping portions are secured together by application of a layer of liquid-resistant PVOH adhesive 30 (although other suitable liquid-resistant adhesives may be used), to form the collapsed urinal shown in FIGS. 5 and 6, having a straight front edge 32, two straight side edges 16, 18 which converge towards, and join with, a respective end of, the front edge 32, and a rear, part-circular end edge 38 which interconnects the opposite ends of the side edges 16, 18. The overlapping portions which form the front straight edge 32 are not secured together, and thereby define a slot 40 which, when the urinal is expanded, will form an opening of the urinal 10, as will be explained.

The fold lines in the lower leaf of the collapsed bottle (see FIG. 6) define a base wall 42 on the undersurface of the urinal, defined by two straight fold lines 44, 46 each extending from a point 47 near the rear end of a respective side edge 16, 18 to a. respective end of a short centrally-disposed fold line 48 extending parallel to the front straight edge 32 and located approximately half the distance from the front straight edge 32 to the furthermost point of the curved rear edge 38. Two further straight fold lines 50, 52 extend from respective ends of the centrally disposed fold line 48 to a point 54 near the front end of the associated side edges 16, 18.

On the opposite, upper leaf of the collapsed urinal (see FIG. 5), two curved fold lines 56, 58 are provided, each extending from the point 47 on the respective side edge 16, 18 where the straight fold lines 44, 46 meet the side edge 16, 18 adjacent the arcuate end edge 38 to the point 54 on the respective side edge 16, 18 where the straight fold lines 50, 52 on the lower leaf meet the side edge 16, 18 adjacent the front edge 32.

The urinal 10 is stored in the flat, collapsed condition shown in FIGS. 5 and 6, in which condition it occupies very little volume compared with a conventional, moulded urinal. When it is desired to use a urinal, a collapsed urinal is transformed into an expanded urinal, shown in FIGS. 1 to 4, by pressing inwardly on the opposite straight side edges 16, 18. This causes the urinal 12 to expand into the condition shown in FIGS. 1 to 4. In particular, it will be observed that the curved fold lines 56, 58 on the upper face of the collapsed urinal and the straight fold lines 44, 46, 48, 50, 52 on the lower face of the collapsed urinal result in the formation of generally lenticular, identical concave recesses 60, 62 on either side of the expanded urinal, with each of the side edges 16, 18 extending down the length of a respective recess from corner to corner. The configuration of the recesses 60, 62 also makes it less likely that the expanded urinal will collapse. The recesses 60, 62 and the angles formed by the folds in the expanded configuration cause external loads applied to the expanded container to tend to force the sides containing these recesses closer together, resulting in a much greater resistance to collapse, which would require these sides to move apart in order to achieve the collapsed configuration.

Figure 1:
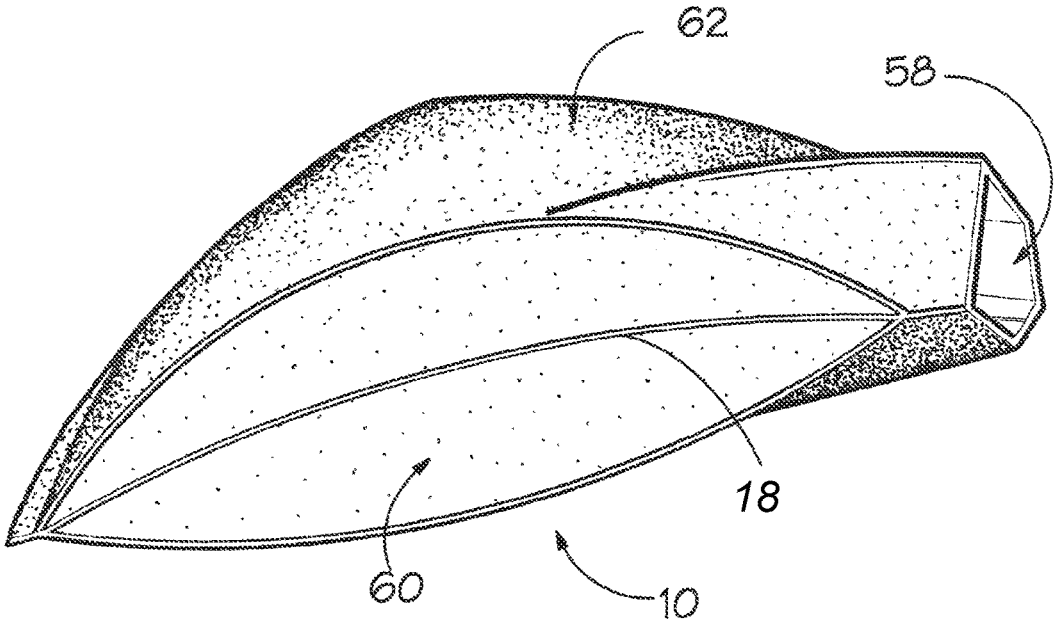
FIG. 1 is a perspective view of a first embodiment of collapsible male urinal in accordance with the present invention, shown in its expanded condition.
Figure 2:
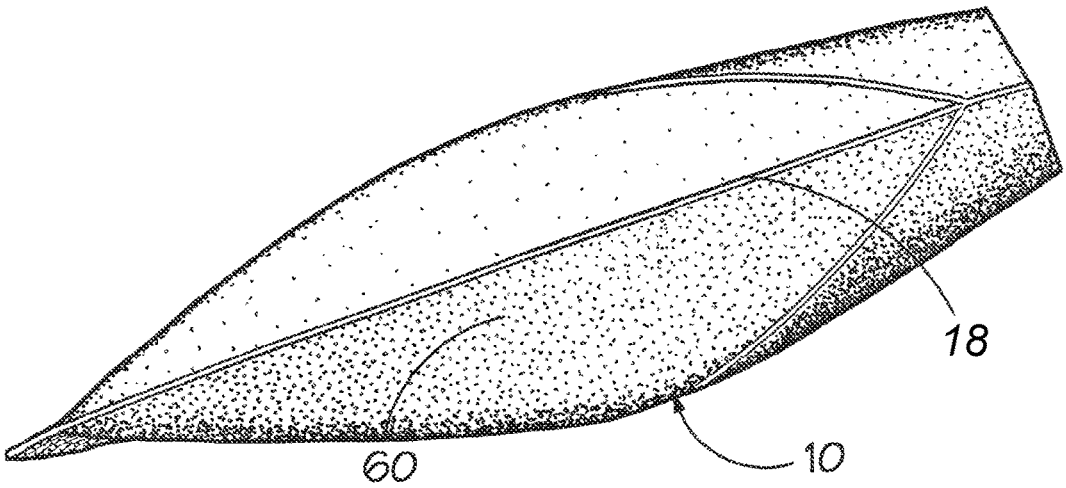
FIG. 2 is a side view of the male urinal of FIG. 1.
Figure 3:
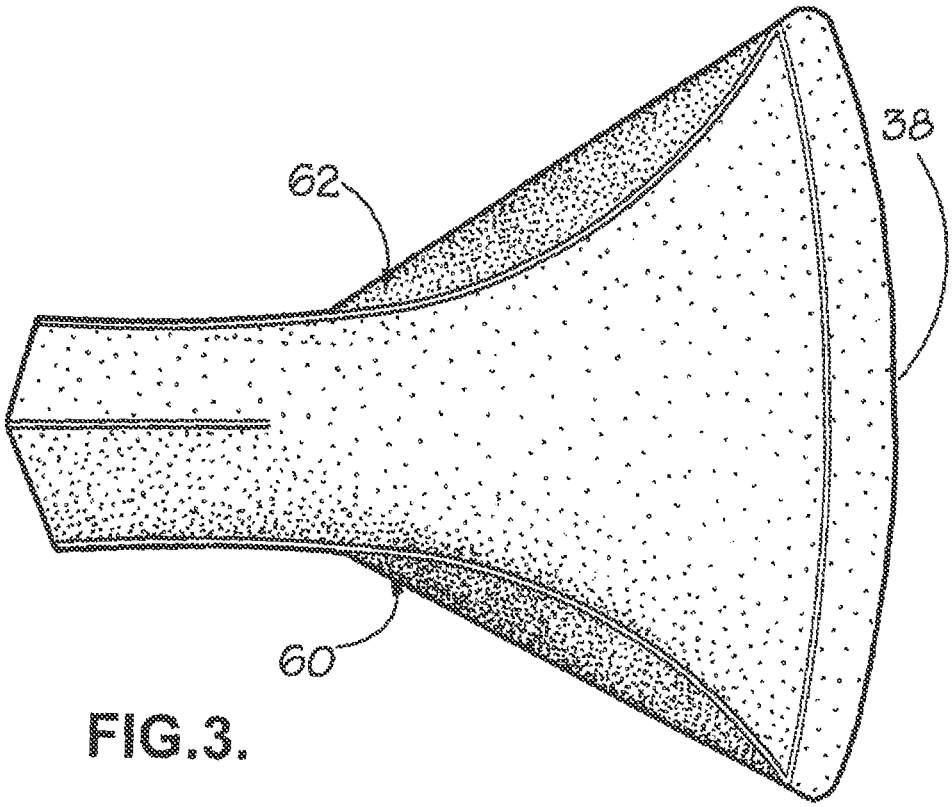
FIG. 3 is a view from above of the male urinal of FIG. 1.
Figure 4:
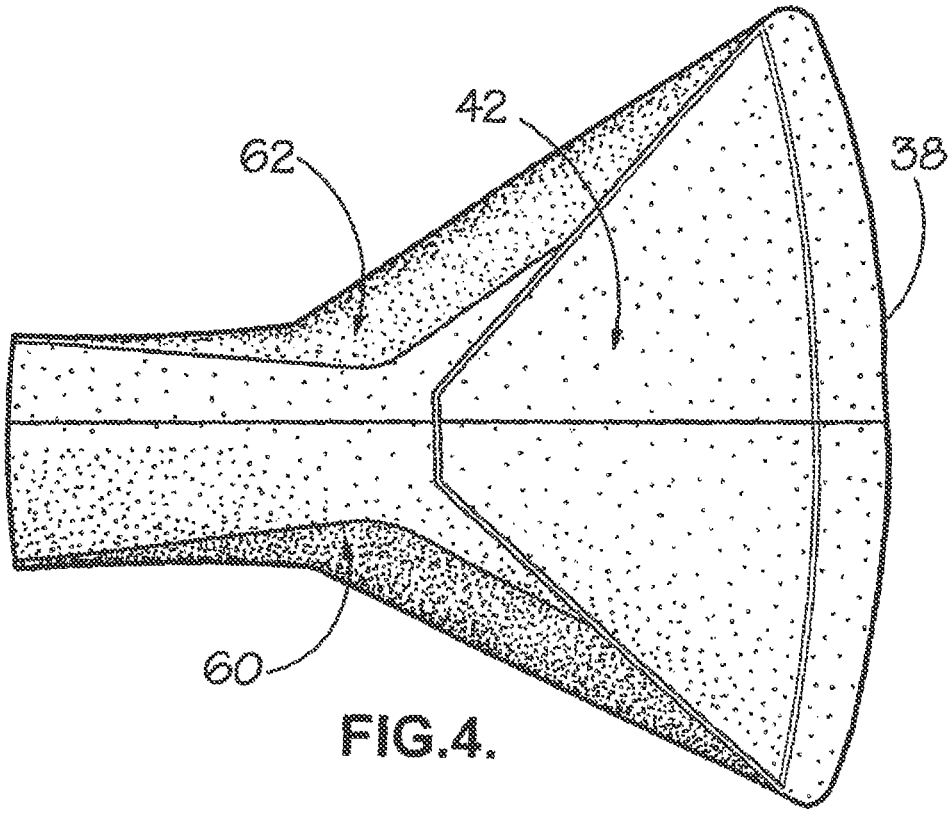
FIG. 4 is a view from below of the male urinal of FIG. 1.

As shown in FIG. 1, when the urinal 10 is in the expanded condition, the two previously abutting leaves of card which form the urinal 10 separate from each other along the front edge 32 and the flow 40 opens to form an opening 58 to the expanded urinal. The urinal can then be used in the same way as prior art urinals and subsequently disposed of in a macerator. The concave recesses 54, 46 which also effectively form the side walls of the expanded urinal, also facilitate manipulation and lifting of the urinal using one hand.

The second embodiment of the invention, shown in FIGS. 8 to 14, is very similar to the first embodiment, the main differences are the number, location and shape of the fold lines. In particular, all of the fold lines on the second embodiment of urinal are straight.

Figure 13:
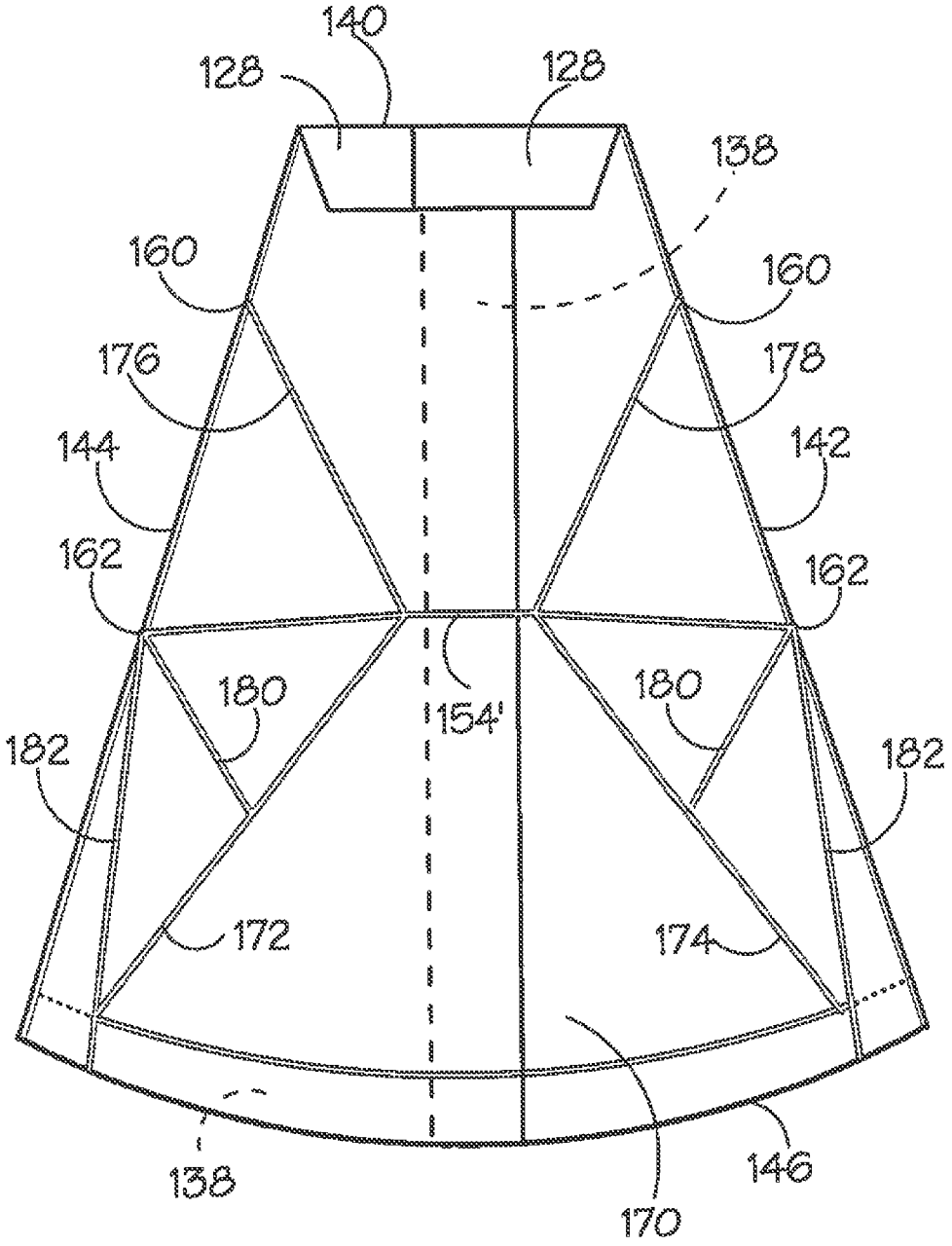
FIG. 13 is a view from below of the male urinal of FIG. 8, shown in a collapsed condition.
Figure 14:
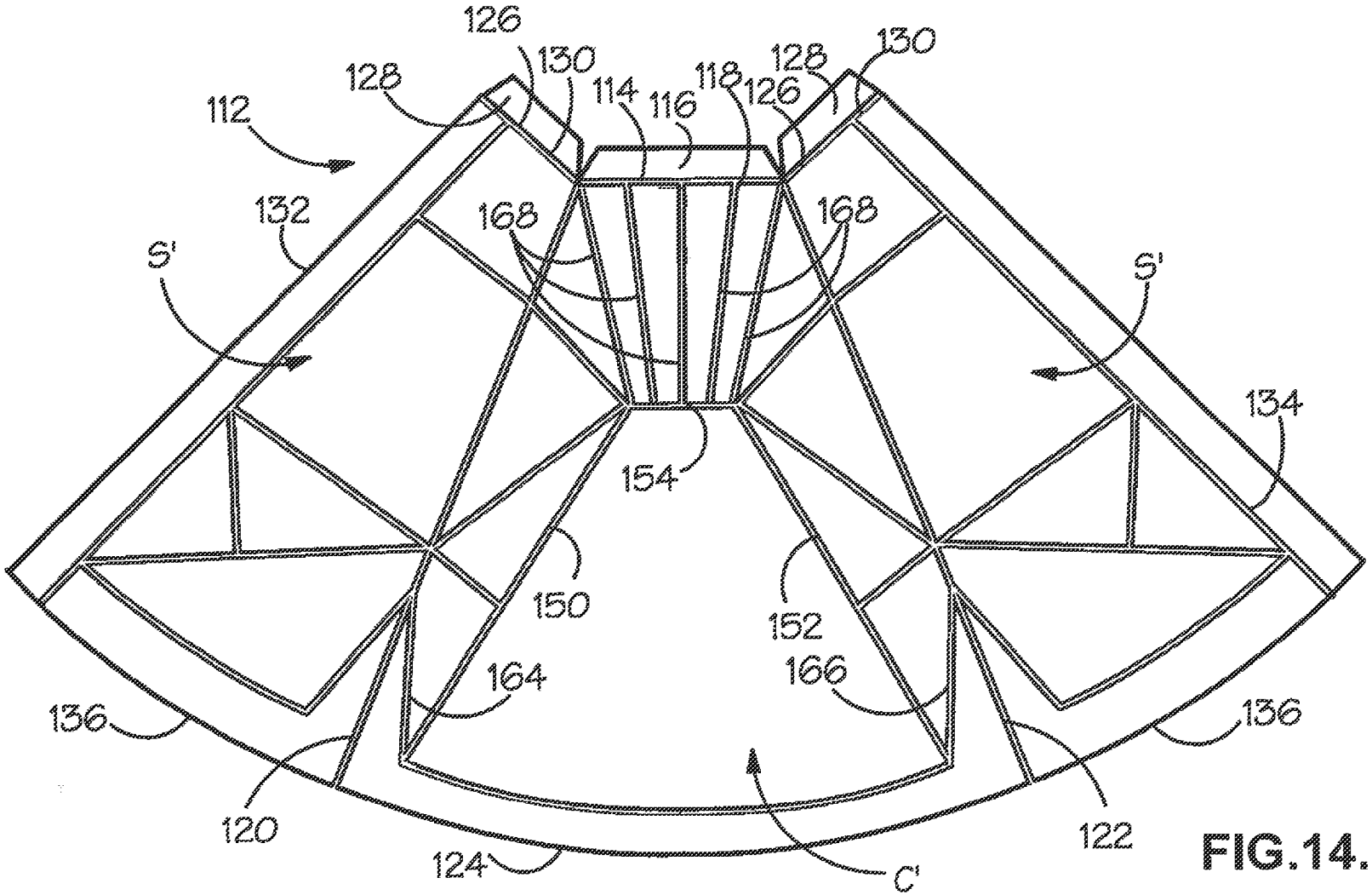
FIG. 14 is a view from above of the cardboard blank from which the male urinal of FIG. 8 is made.
Figure 15:
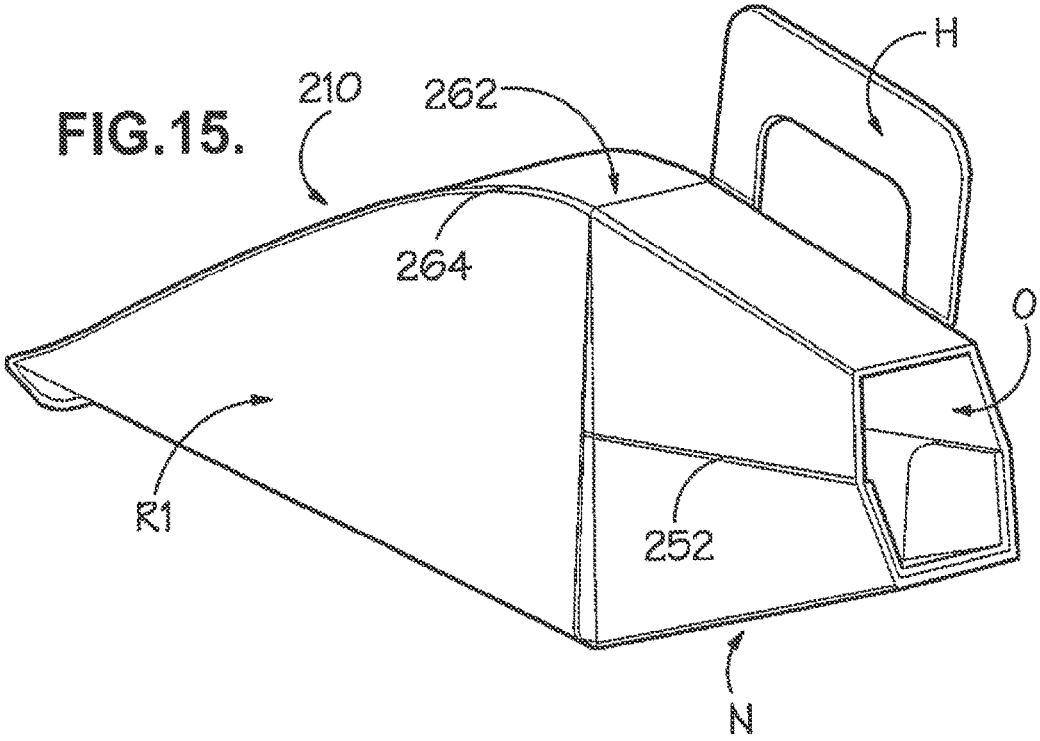
FIG. 15 is a perspective view from above of a third embodiment of collapsible male urinal in accordance with the present invention, shown in its expanded condition.
Figure 16:
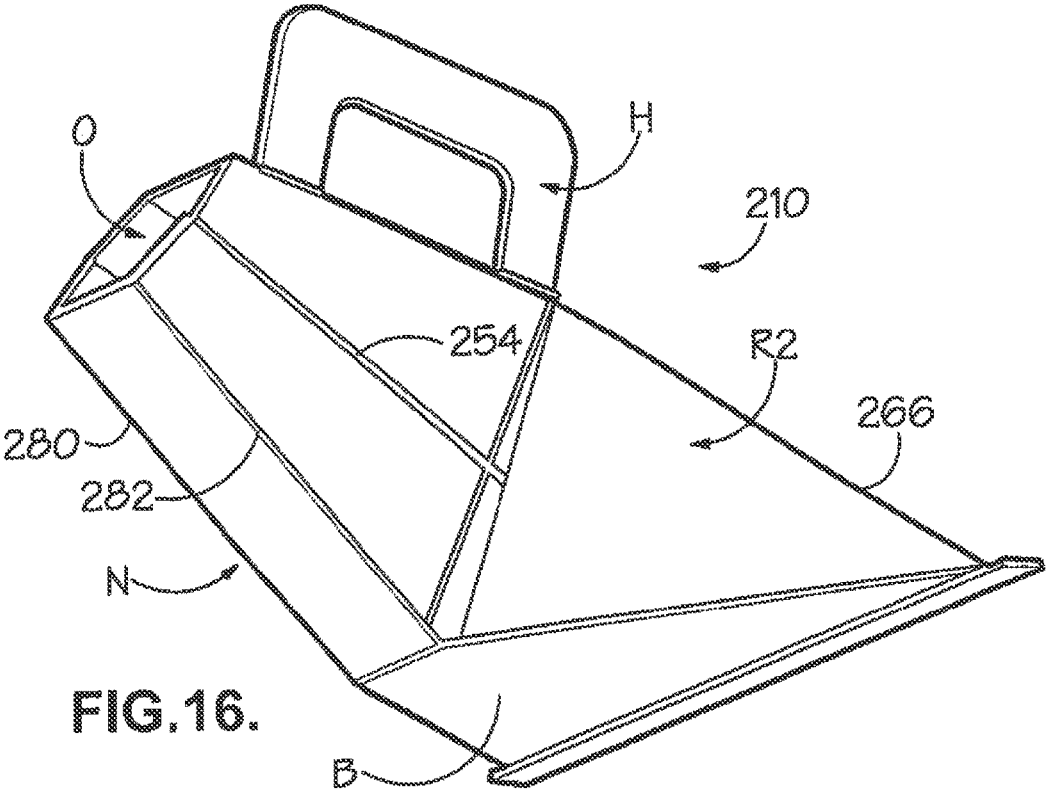
FIG. 16 is a perspective view from below of the male urinal of FIG. 15.
Figure 17:
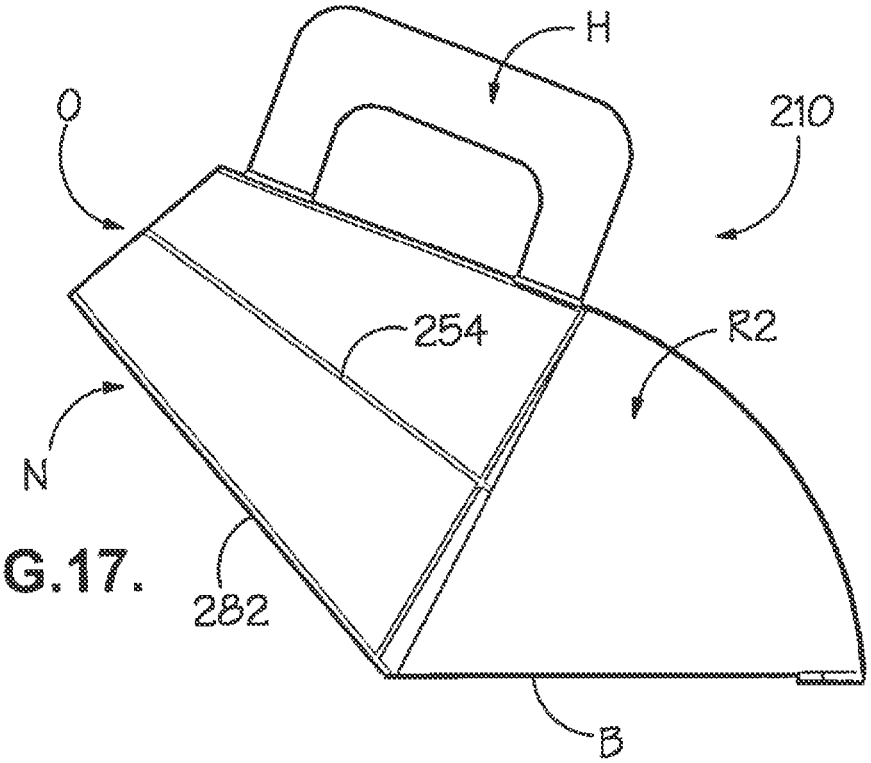
FIG. 17 is a side view of the male urinal of FIG. 15.
Figure 18:
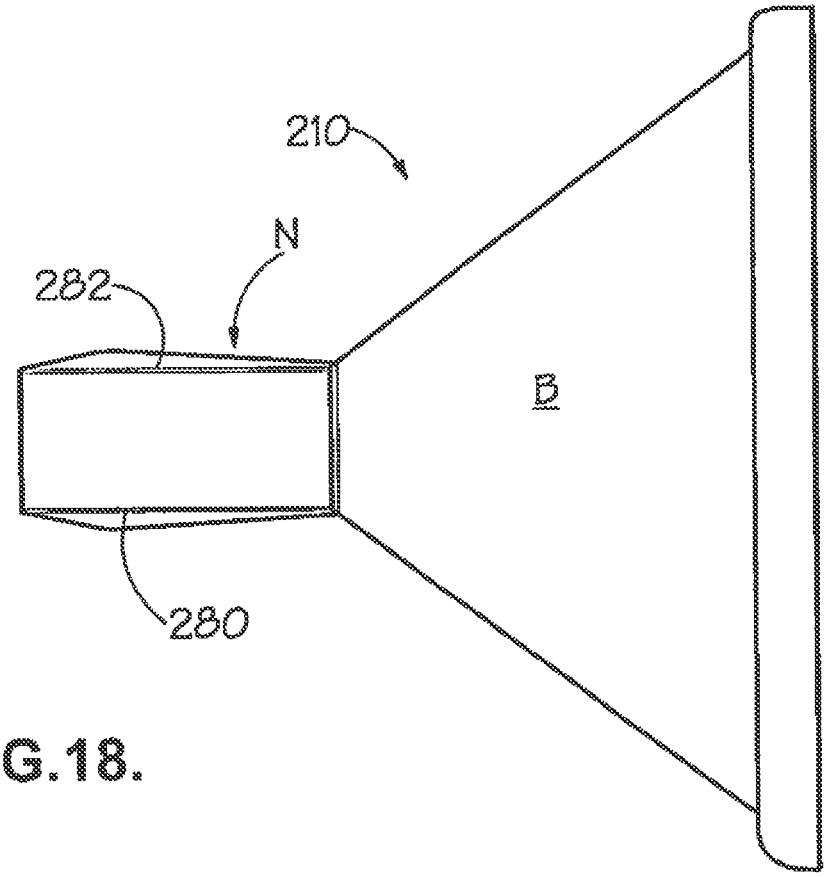
FIG. 18 is a view from below of the male urinal of FIG. 15.
Figure 19:
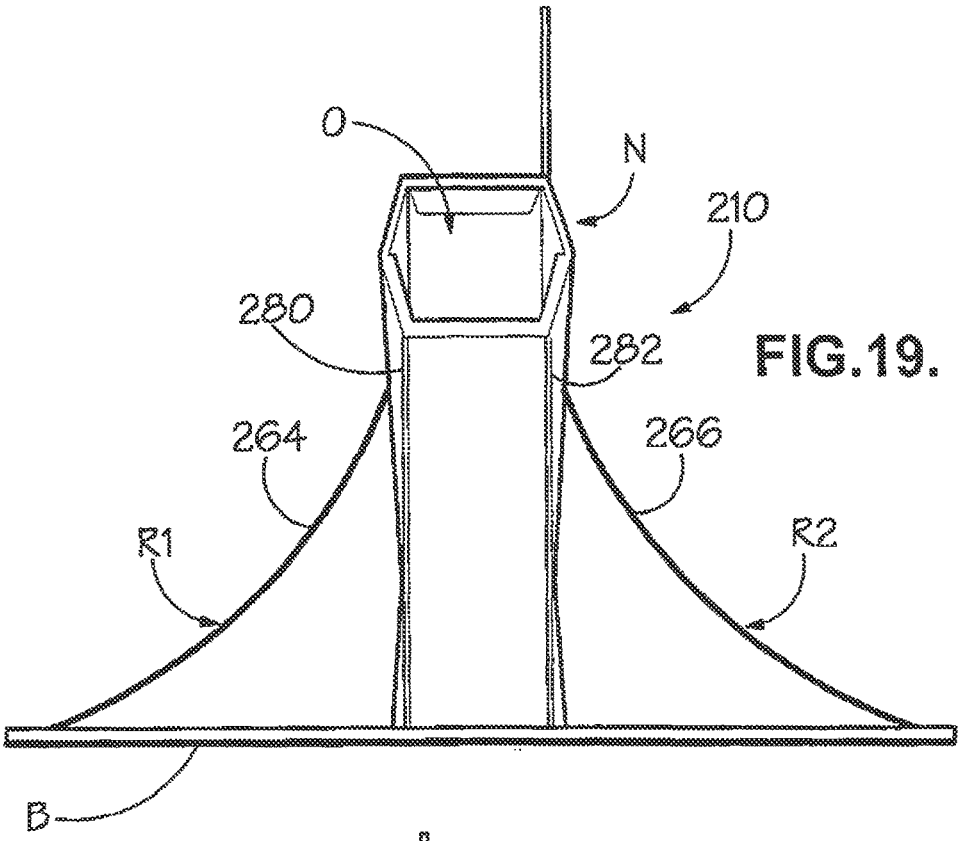
FIG. 19 is a front view of the male urinal of FIG. 1.
Figure 20:
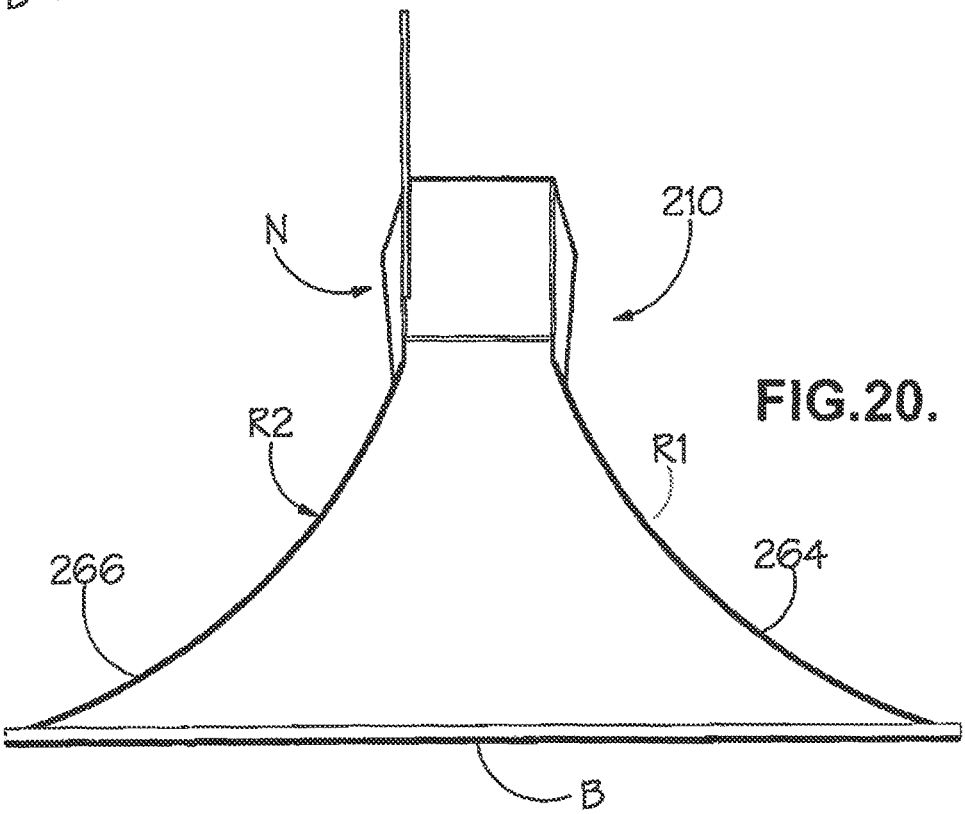
FIG. 20 is a rear view of the male urinal of FIG. 15.
Figure 21:
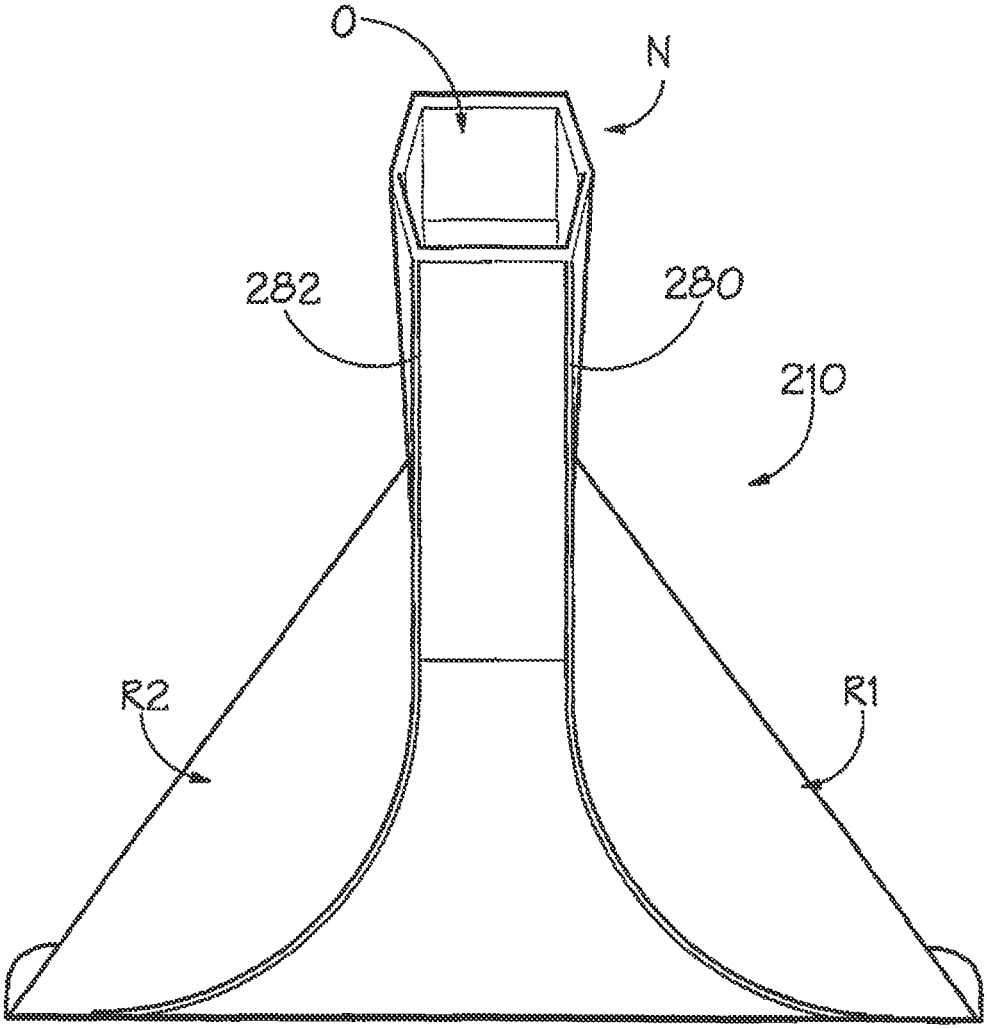
FIG. 21 is a view from above of the male urinal of FIG. 20.

As for the first embodiment, the second embodiment is a male urinal 110 formed from a sheet of cardboard, out of which is stamped the blank 112 shown in FIG. 14. The blank 112 is folded and glued to form the collapsed urinal shown in FIGS. 12 and 13, which may be expanded when required to form the expanded urinal 110 shown in FIGS. 8 to 11, in which condition it is ready to use. As for the first embodiment, the materials from which the urinal is constructed are such that the bottle is maceratable and the card from which the urinal 110 is constructed is also treated to make it impervious to urine for a predetermined period.

As best seen in FIG. 14, the blank 112 comprises a central panel C' having a short straight front edge 114 to which a short projecting flap 116 is connected by means of a fold line 118, two straight side edges 120, 122 which converge towards, and join, a respective end of the front edge 114, and a part-circular rear edge 124 which connects the other end is of the side edges 120, 122. Two side panels S', mirror images of each other, extend from a respective one of the two side edges 120, 122 of the central panel C'. Each side panel S' comprises a straight front edge 126, to each of which a short projecting flap 128 is connected by means of a fold line 130, a straight outer edge 132, 134 and a rounded, part-circular rear edge 136. The part-circular rear edge 136 is the same radius as the part-circular rear edge 124 of the central panel C' and the side panels S' are slightly wider than the width of the central panel C'. Consequently, when the side panels S' are folded in towards each other along the respective fold lines formed by the side edges 120, 122 of the central panel C', they lie flat on the surface of the central panel and the edges of the side panels S' overlap each other, as do the peripheries of the part-circular rear edges 124, 136 of the central panel C' and the side panels S'.

Figure 12:
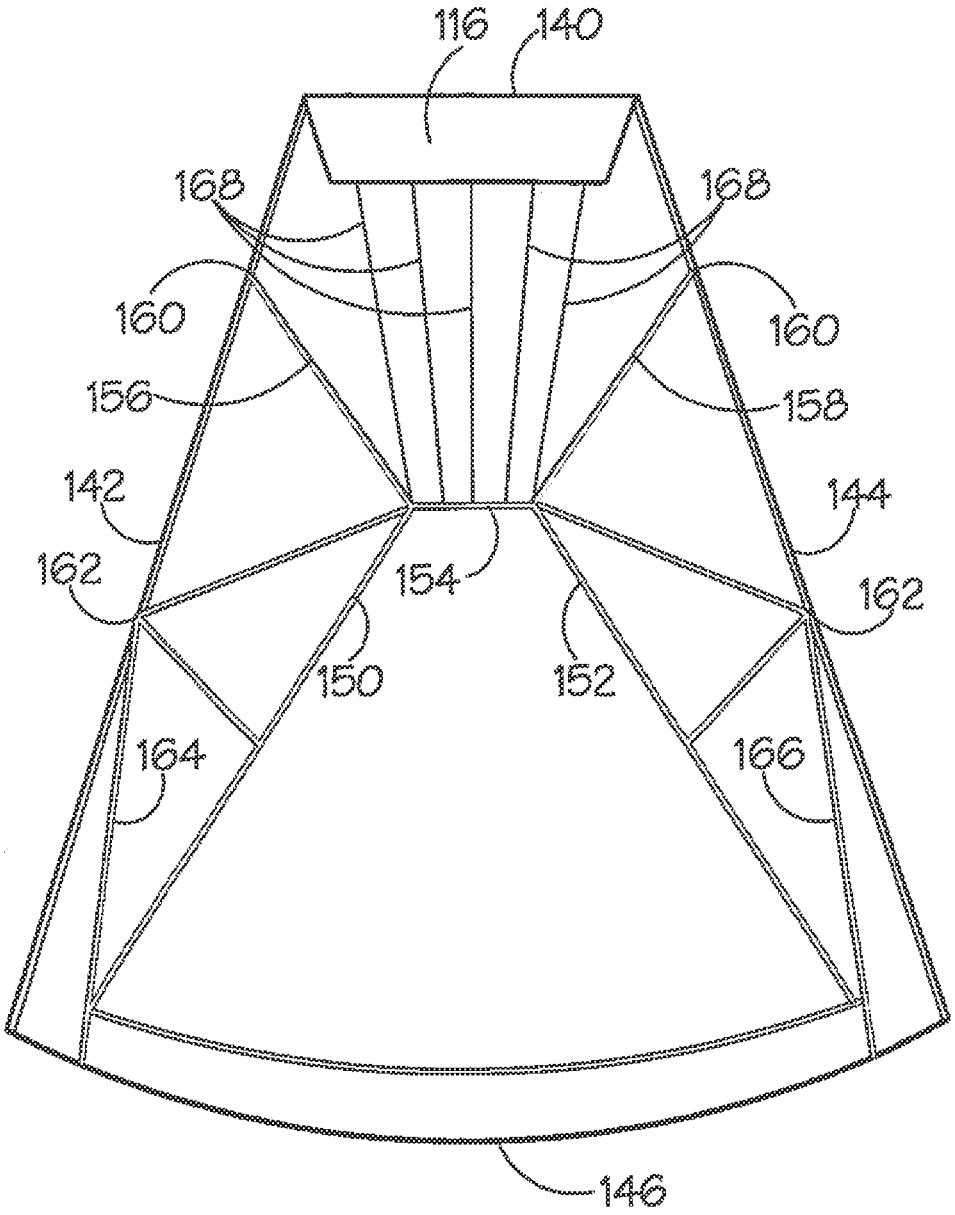
FIG. 12 is a view from above of the male urinal of FIG. 8, shown in a collapsed condition.

The overlapping portions are secured together by application of a liquid-resistant PVOH adhesive 138 to form the collapsed urinal shown in FIGS. 12 and 13, having a straight front edge 140, two straight side edges 142, 144 which converge towards, and join with, a respective end of the front edge 140 and the rear, part-circular end edge 146 which interconnects the opposite ends of the side edges 142, 144. The overlapping portions which form the front straight edge 140 are not secured together and thereby define a slot which, when the urinal is expanded, will form an opening of the urinal, as will be explained. It will also be observed that the short projecting flaps 116, 128, are folded back over, and glued to, the outer surface of the urinal adjacent to the unglued portion which will form the opening of the urinal.

The fold lines in the upper leaf of the collapsed bottle (see FIG. 13) define an upper wall 148 on the upper surface of the urinal, defined by two straight fold lines 150, 152 each extending from a location near the rear end of a respective side edge 142, 144 to a respective end of a short centrally-disposed fold line 154 extending parallel to the front straight edge 140 and located approximately one third the distance from the front straight edge to the further most point of the curved rear edge 146.

Two further fold lines 156, 158 extend from each end of the central fold line 154, the first fold line extending to a point 160 on the respective side edge 142, 144 approximately one fifth of the length of the side edge from the front straight edge 140 and the second fold line extending to a point 162 approximately half way along the respective side edge 142, 144. Further fold lines 164, 166 extend from the midpoint and the furthest end point of the fold lines 150, 152 to the point 162.

It will also be observed that five fold lines 168 extend from the central fold line 154 to the front straight edge. The fold lines 168 are equally spaced at the central fold line 154, but fan outwardly away from the fold line 154.

The fold lines in the lower leaf of the collapsed bottle (see FIG. 14) define a lower wall 170 on the lower surface of the urinal, defined by two straight fold lines 172, 174 each extending from a location near the rear end of a respective side edge 142, 144 to a respective end of a short centrally-disposed fold line 154' extending parallel to the front straight edge 140 and located approximately one third the distance from the front straight edge to the further most point of the curved rear edge 146.

Two further fold lines 176, 178 extend from each end of the central fold line 154, the first fold line extending to the point 160 on the respective side edge 142, 144 approximately one fifth of the length of the side edge from the front straight edge 140 and the second fold line extending to the point 162 approximately half way along the respective side edge 142, 144. Further fold lines 180, 182 extend from the midpoint and the furthest end point of the fold lines 172, 174 to the point 162.

As for the first embodiment, the urinal is stored in the flat, collapsed condition shown in FIGS. 12 and 13, in which condition it occupies very little volume. When it is desired to use a urinal, a collapsed urinal is transformed into an expanded urinal shown in FIGS. 8 to 11 by pressing inwardly on the opposite straight side edges 142, 144. This causes the urinal to expand into the condition shown in FIGS. 8 to 11. In particular, it will be observed that the fold lines on the upper and lower faces of the collapsed urinal results in the formation of identical, generally diamond-shaped concave recesses 184, 186 on either side of the expanded urinal, with the side edges 142, 144 extending along the length of the recesses from corner to corner.

When the urinal is in the expanded condition, the two previously abutting leaves of card which form the urinal separate from each other along the front edge, forming an opening 190 to the expanded urinal. The urinal can then be used in the same way as prior art urinals and subsequently disposed of in a macerator. The concave recesses 184, 186, which also effectively form the side walls of expanded urinal, also facilitate manipulation and lifting of the urinal using one hand.

The five fold lines 168 on the upper leaf of the urinal 110 help to form a more tubular opening or neck portion to the expanded urinal.

The third embodiment of the invention, shown in FIGS. 15 to 24, is very similar to the first and second embodiments, the main differences being the number, location and shape of the fold lines.

Figure 22:
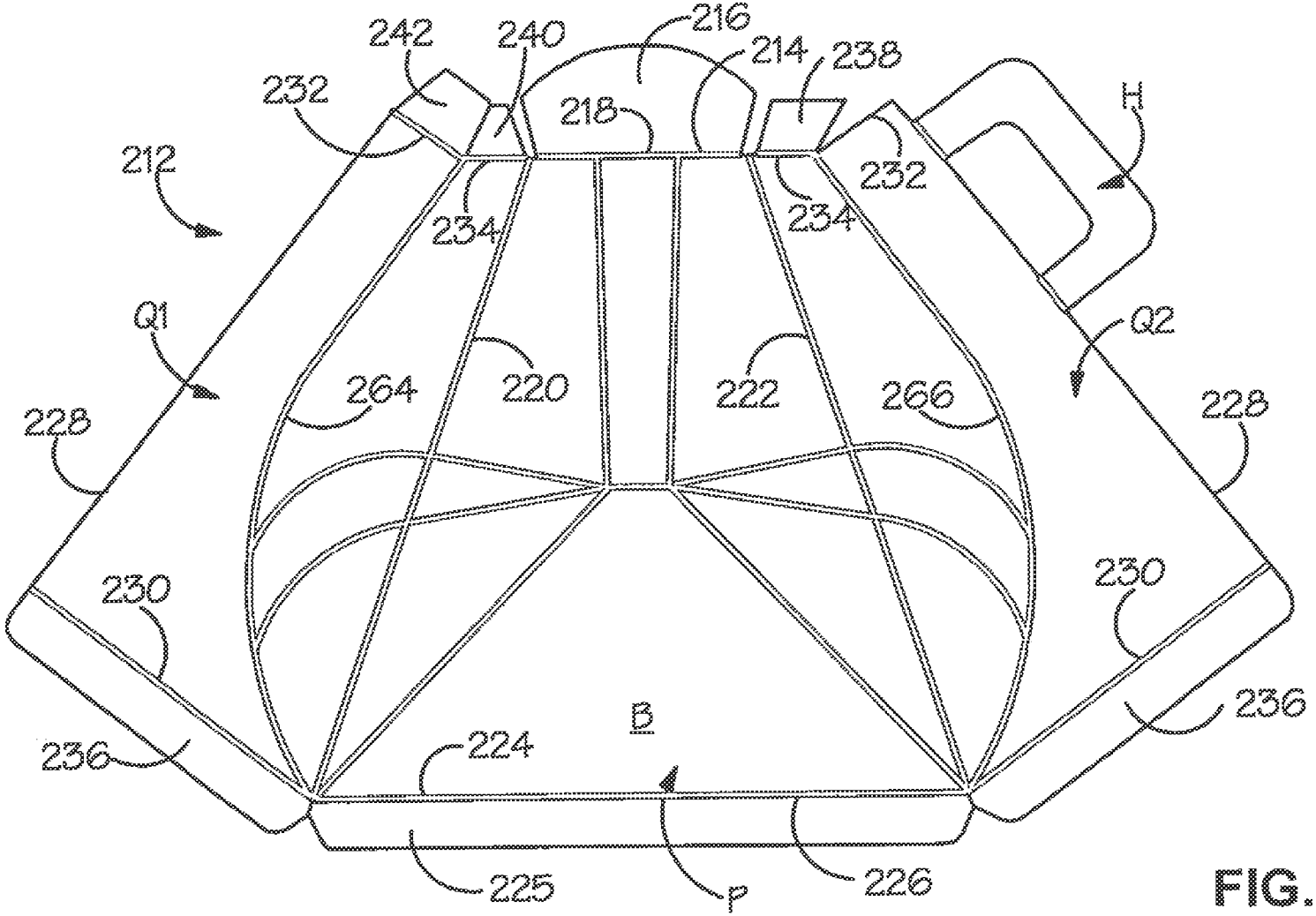
FIG. 22 is a view from above of the cardboard blank from which the male urinal of FIG. 15 is made.

As for the first and second embodiments, the third embodiment is a male urinal 210 formed from a sheet of cardboard out of which is stamped the blank 212 shown in FIG. 22. The blank 212 is folded and glued to form a collapsed urinal, shown in FIGS. 23 and 24, which may be expanded when required to form the expanded urinal 210 shown in FIGS. 15 to 21, in which condition it is ready to use.

As for the first and second embodiments, the materials from which the urinal is constructed are such that the bottle is maceratable and the card from which the urinal 210 is constructed is also treated to make it impervious to urine for a predetermined period.

As best seen in FIG. 22, the blank 212 comprises a central panel P having a short straight front edge 214 to which a projecting flap 216 is connected by means of a fold line 218, two straight side edges 220, 222 which converge towards, and join, a respective end of the front edge 214, and a straight rear edge 224 which connects the other ends of the side edges 220, 222. An elongate flap 225 extends along the length of the rear edge 224 and is attached thereto by means of a straight fold line 226.

Two side panels Q1, Q2, mirror images of each other (with the exception of a handle H on side panel Q2 and reinforcing flaps at the upper edges, as will be explained) extend from a respective one of the two side edges 220, 222 of the central panel P. Each side panel Q1, Q2 comprises a straight outer edge 228, a straight rear edge 230 extending perpendicularly to the outer edge 228 and a front edge having a first portion 232 extending perpendicularly to the outer edge 228 and a second portion 234 which is an extension of the straight front edge of the central panel P. Elongate securing panels 236 extend along the rear edge of each of the side panels Q1, Q2 and securing flaps 238, 240 and 242 extend from the front edge of the portions 234 of the first and second flaps Q1, Q2 and from the front edge 232 of the side panel Q1.

A U-shaped handle portion H also extends outwardly from the outer edge 228 of the side panel Q2.

The side panels Q1, Q2 are dimensioned such that when they are folded in towards each other along the respective fold lines formed by the side edges 220, 222 of the central panel P, they lie flat on the surface of the central panel P and the edges of the side panels Q1, Q2 overlap each other, and the straight rear edges 230 of the side panels Q1, Q2 lie immediately above the straight rear edge 224 of the central panel P, with the securing flaps 236 of the panels Q1, Q2 overlapping each other and overlying the flap 225 of the central panel P.

Figure 23:
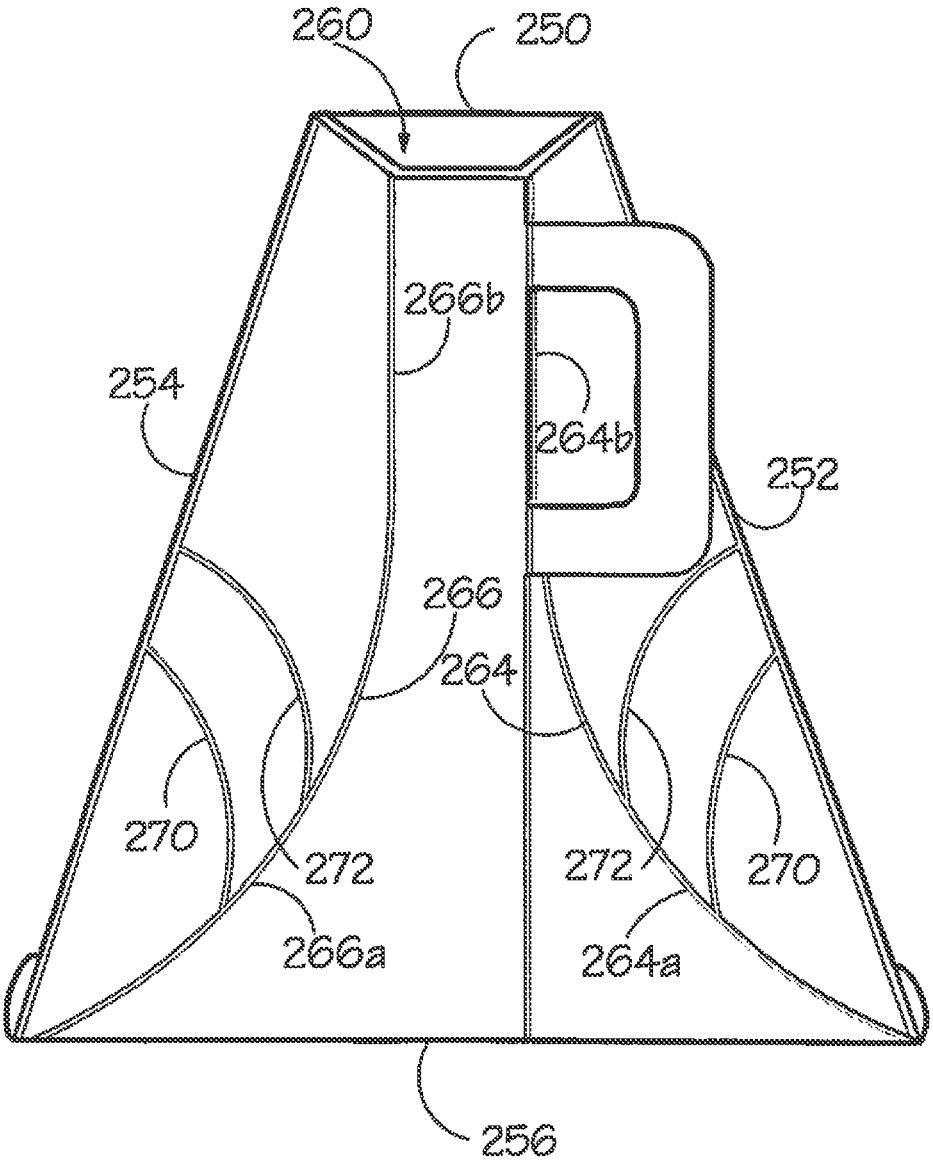
FIG. 23 is a view from above of the urinal of FIG. 15, shown in a collapsed condition.
Figure 24:
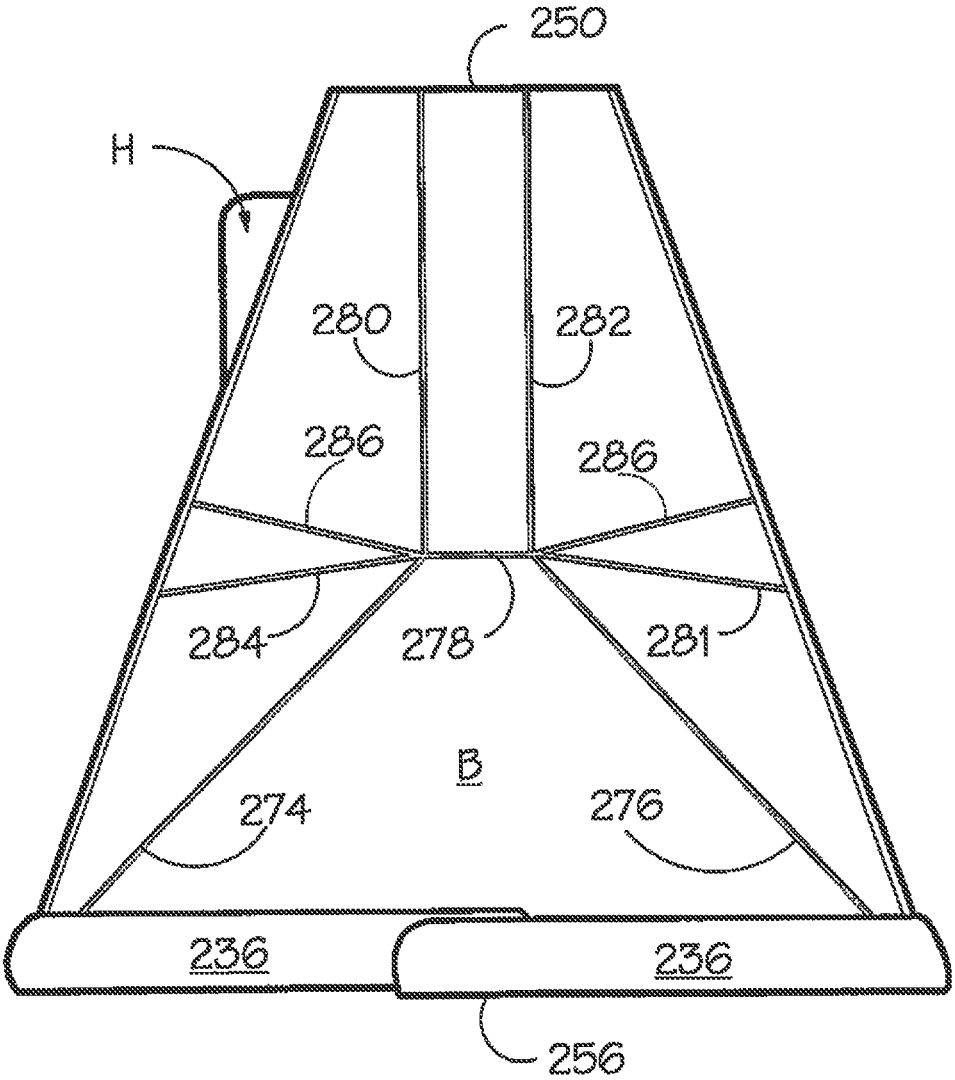
FIG. 24 is a view from below of the urinal of FIG. 15, shown in the collapsed condition.

The overlapping portions are secured together by application of a liquid resistant PVOH adhesive to form the collapsed urinal shown in FIGS. 23 and 24, having a straight front edge 250, two straight side edges 252, 254 which converge towards, and join with, the respective end of the front edge 140 and the rear straight edge 256 which interconnects the opposite ends of the side edges 252, 254. The overlapping portions which form the front straight edge 250 are not secured together and thereby define a slot 260 which, when the urinal is expanded, will form an opening O of the urinal, as will be explained.

The flaps 236 of the side panels Q1, Q2 and the flap 225 of the central panel P are glued to each other and are also folded back over, and glued to, the outer surface of the urinal. In addition, the flaps 216, 238, 240 and 242 at the upper edge of the urinal are folded back over, and glued to, the inner surface of the urinal adjacent to the edge in order to reinforce the portion of the blank which will form the opening O of the urinal.

It will also be observed that the handle portion H is not glued to the rest of the male urinal but is merely connected to elongate edge 228 of side panel Q2 along connecting folds.

The fold lines in the upper leaf of the collapsed bottle define an upper wall 262 on the upper surface of the urinal, defined by two fold lines 264, 266 which are symmetrical about the longitudinal axis of the collapsed urinal. The fold lines comprise a curved portion 264*a*, 266*a* extending from the lower corners of the collapsed urinal, which merge into two straight, parallel fold lines 264*b*, 266*b* where they meet the unglued slot portion 260 which will form the opening O of the urinal.

Two further curved fold lines 270, 272 extend from the curved portion of each of the aforementioned fold lines on the upper leaf, to the respective lateral edges of the collapsed urinal.

The fold lines in the lower leaf of the collapsed bottle define a lower, trapezoidal base wall B defined by two straight fold lines 274, 276 extending from the lower corners of the collapsed urinal to a respective end of a short centrally-disposed fold line 278 extending parallel to the rear edge 256 and located approximately halfway between the front and rear edges of the collapsed urinal.

Two further fold lines 280, 282 extend from each end of the central fold line, almost parallel to each other but diverging slightly, towards the front edge 250 of the collapsed urinal.

Further straight fold lines 284, 286 extend from the junction of the aforementioned curved fold lines 270, 272 and the respective lateral edges 252, 254 of the collapsed urinal. These further fold lines are straight and converge at the respective ends of the central fold line.

As for the first and second embodiments, the urinal is stored in the flat, collapsed condition in which it occupies very little volume. When it is desired to use the urinal, a collapsed urinal is transformed into an expanded urinal shown in FIGS. 15 to 22 by pressing inwardly on the opposite straight side edges. This causes the urinal to expand into the condition shown in FIGS. 15 to 22 and in particular forms an elongate tubular neck portion N having the opening O at its upper end. In particular, it will be observed that the fold lines on the upper and lower faces of the collapsed urinal results in the formation of identical, generally curved recesses R1, R2 on either side of the expanded urinal, with the side edges extending along the length of the recesses from corner to corner.

When the urinal is in the expanded condition, the two previously abutting leaves of card which form the urinal separate from each other along the front edge, forming an opening O to the expanded urinal. The urinal can then be used in the same way as prior art urinals and subsequently disposed of in a macerator. The concave recesses which also effectively form the side walls of the expanded urinal also facilitate manipulation and lifting of the urinal using one hand.

It will also be observed that the expanded urinal can be rested on the base wall before, during and after use. After use, the urinal can be disposed of in a macerator, as for the previous two embodiments.

The invention is not restricted to the details of the foregoing embodiments. For example, although the specific description refers to the urinals being made from paper pulp card, other sheet materials including (but not limited to) paperboard and paper may be used instead.

Also, other types of adhesive may be used instead of, or in addition to, PVOH adhesive. Indeed, other methods of securing the edges of the blank to form the collapsed container may be used, for example heat sealing.

Moreover, although the specific embodiments refer to urinals, the invention is also applicable to other types of container including (but not limited to) bottles, for example.

The invention claimed is:

1. A urine bottle formed from sheet material, the urine bottle comprising:

an enclosing wall and an aperture and being expandable from a first, collapsed configuration into a second, expanded configuration, the sheet material having a plurality of fold lines which define two recesses located on opposite sides of the enclosing wall of the container in the expanded configuration, wherein in the first, collapsed configuration the urine bottle comprises a lower leaf and an upper leaf overlying the lower leaf, the upper leaf and the lower leaf being sealed together along their lateral edges and along a first, end edge extending between a first end of each of the lateral edges, the lateral edges tapering towards each other from a respective end of the end edge to the aperture, the aperture extending between the second, opposite ends of the lateral edges, and wherein in the second, expanded, configuration each of the lateral edges extends across a respective one of the two recesses.

2. The urine bottle as claimed in claim 1, wherein the upper leaf and lower leaf are of substantially the same shape and dimensions.

3. The urine bottle as claimed in claim 1, wherein the lower leaf comprises a plurality of fold lines which form a base wall when the urine bottle is in the second, expanded configuration.

4. The urine bottle as claimed in claim 1, comprising one or more arcuate fold lines which define a recess in the enclosing wall of the urine bottle in the second, expanded configuration.

5. The urine bottle as claimed in claim 1, wherein the plurality of fold lines in the sheet material define the two recesses in the enclosing wall of the urine bottle in the second, expanded configuration.

6. The urine bottle as claimed in claim 1, wherein the urine bottle is formed from a single foldable blank.

7. The urine bottle as claimed in claim 1, wherein the material from which the urine bottle is made is maceratable.

8. The urine bottle as claimed in claim 1, wherein transformation from the first, collapsed configuration to the second, expanded configuration to form the plurality of two recesses retains the urine bottle in the second, expanded configuration.

9. The urine bottle as claimed in claim 1, wherein when the urine bottle is in the first, collapsed configuration, each of the upper leaf and the lower leaf is substantially planar and comprises a front edge, two side edges which form the lateral edges of the container in the first, collapsed configuration and a rear edge, the front edge joining one end of each of the side edges and the rear edge joining the other end of the side edges.

10. The urine bottle as claimed in claim 9, wherein the side edges and rear edges of the upper leaf and the lower leaf are joined to each other.

11. The urine bottle as claimed in claim 9, wherein the front edges of the upper leaf and the lower leaf are not joined to each other.

12. The urine bottle as claimed in claim 9, wherein the rear edge is arcuate.

13. The urine bottle as claimed in claim 12, wherein the rear edge is part-circular.

14. The urine bottle as claimed in claim 9, wherein the side edges of the upper leaf and the lower leaf extend along the two recesses.

15. The urine bottle as claimed in claim 1, wherein the urine bottle is formed from a foldable sheet.

16. The urine bottle as claimed in claim 15, wherein the sheet is liquid resistant.

17. The urine bottle as claimed in claim 15, wherein the urine bottle is formed a foldable card.

18. The urine bottle as claimed in claim 17, wherein the foldable card comprises a paper pulp card.

* * * * *